US006763556B2

(12) United States Patent
Fagan et al.

(10) Patent No.: US 6,763,556 B2
(45) Date of Patent: Jul. 20, 2004

(54) MATING FILM AND METHOD FOR BUNDLING AND WRAPPING

(75) Inventors: Mark E. Fagan, Woodbury, MN (US); Robert K. Galkiewicz, Roseville, MN (US); Scott D. Pearson, Woodbury, MN (US); Brian E. Spiewak, Inver Grove Heights, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 10/150,478

(22) Filed: May 17, 2002

(65) Prior Publication Data

US 2003/0051320 A1 Mar. 20, 2003

Related U.S. Application Data

(60) Provisional application No. 60/323,150, filed on Sep. 18, 2001.

(51) Int. Cl.[7] ..... A44B 18/00
(52) U.S. Cl. ..... 24/584.1; 24/452
(58) Field of Search ..... 24/584.1, 452, 24/572.1, 585.1, 306, 442, 444, 447, 450, 443; 428/99, 100; 604/391

(56) References Cited

U.S. PATENT DOCUMENTS

| | | | |
|---|---|---|---|
| 2,717,437 A | 9/1955 | de Mestral | |
| 3,009,235 A | 11/1961 | de Mestral | |
| 3,266,113 A | 8/1966 | Flanagan, Jr. | |
| 3,557,413 A | 1/1971 | Engle | |

(List continued on next page.)

FOREIGN PATENT DOCUMENTS

| | | | |
|---|---|---|---|
| EP | 0325528 | | 7/1989 |
| GB | 760697 | | 7/1956 |
| JP | 04-109904 | * | 4/1992 |
| JP | 10324364 | | 8/1998 |
| WO | WO 99/17630 | | 4/1999 |
| WO | WO 01/58302 | | 8/2001 |
| WO | WO 01/58780 | | 8/2001 |

OTHER PUBLICATIONS

U.S. patent application Ser. No. 09/953,316, filed Sep. 13, 2001, Stretch Releasing Adhesive Tape Article with Bundling Strap.

*Primary Examiner*—Anthony Knight
*Assistant Examiner*—Andre' L. Jackson
(74) *Attorney, Agent, or Firm*—George W. Jonas

(57) ABSTRACT

The invention is a mating film. The mating film comprises a base sheet having a first major surface. A plurality of generally parallel ridges project from the first major surface. The ridges comprise a stem portion attached to the base sheet and generally upright from the base sheet. A head portion of each ridge is spaced from the first major surface and extends generally laterally from the stem portion so as to define a lateral distance. The center of each stem portion of each ridge is spaced from the center of each adjacent ridge stem portion by a distance greater than about 2 times lateral distance defined by the head portion.

22 Claims, 6 Drawing Sheets

U.S. PATENT DOCUMENTS 3,586,220 A 6/1971 Reinsberg
3,592,428 A * 7/1971 McFarlane ..... 248/64
3,682,163 A * 8/1972 Plummer ..... 602/6
4,046,408 A * 9/1977 Ausnit ..... 285/188
4,290,174 A 9/1981 Kalleberg
4,894,060 A 1/1990 Nestegard
5,119,531 A 6/1992 Berger et al.
5,179,767 A * 1/1993 Allan ..... 24/442
5,235,731 A 8/1993 Anzai et al.
5,269,776 A * 12/1993 Lancaster et al. ..... 604/387
5,396,687 A * 3/1995 Osterman ..... 24/449
5,500,268 A * 3/1996 Billarant ..... 428/100
5,611,122 A * 3/1997 Torigoe et al. ..... 24/442
5,671,511 A * 9/1997 Hattori et al. ..... 24/444
5,713,111 A * 2/1998 Hattori et al. ..... 24/452
5,797,170 A * 8/1998 Akeno ..... 24/452
5,851,467 A * 12/1998 Murasaki ..... 264/167
5,867,876 A * 2/1999 Petersen ..... 24/452
5,888,621 A 3/1999 Fröhlich et al.
5,953,797 A * 9/1999 Provost et al. ..... 24/452
6,061,881 A * 5/2000 Takizawa et al. ..... 24/446
6,106,922 A 8/2000 Cejka et al.
6,367,128 B1 4/2002 Galkiewicz et al.
6,460,230 B2 * 10/2002 Shimamura et al. ..... 24/452
6,546,604 B2 * 4/2003 Galkiewicz et al. ..... 24/572.1
2001/0018785 A1 9/2001 Galkievicz et al.

* cited by examiner

MATING FILM AND METHOD FOR BUNDLING AND WRAPPING

CROSS REFERENCE TO RELATED APPLICATION

This application claims priority to U.S. Provisional Patent Application No. 60/323,150, filed Sep. 18, 2001, incorporated by reference in its entirety herein.

FIELD OF THE INVENTION

This invention relates to mechanical fasteners and particularly to self mating mechanical fasteners.

BACKGROUND OF INVENTION

Hook-and-loop fasteners (See for example, U.S. Pat. Nos. 2,717,437 and 3,009,235 both of which are incorporated by reference in their entirety herein) are in common, everyday use; but they still have important deficiencies. For example, the hook-and-loop composite is a relatively thick laminate, and can be conspicuous, e.g., in clothing applications. Further, loop material, especially in robust constructions, can be relatively costly. And opening or unfastening hook-and-loop fasteners can cause detachment of loops from their substrates, with a consequent generation of particulate debris. Additionally, the potential for particulate debris in hook-and-loop fasteners precludes their use in clean room environments and other areas where debris is destructive. Finally, the hook-and-loop type fasteners can involve a relatively complicated manufacturing process.

A wide variety of different fasteners have been taught as alternatives or replacements for hook-and-loop fasteners, including molded and extruded articles that have protruding inter-engaging elements having heads. See, for example, the fasteners described in U.S. Pat. Nos. 3,266,113, 4,290,174, 4,894,060, 5,119,531, 5,235,731, 3,586,220, 5,119,531, 5,888,621, 3,557,413, 6,106,922, 6,367,128 and PCT published application number WO 01/58780 all of which are incorporated by reference in their entirety herein. Many of these fasteners are self-mating, i.e., fastening is accomplished by interengaging fastener units of identical shape. In particular, many of the fasteners utilize protruding elements or "hooks", which are mounted to a first fastener portion and are spaced apart so as to provide a "receptacle" into which a mating element on a second fastener portion is forcibly inserted, thereby locking the two portions of the fastener in place.

This representative approach utilizing a profile-extruded self-mating film is shown in FIGS. 1 and 2. In this approach, two surfaces of ridge type hooks can be pressed together to make the hooks interlock. It is important to note that the ridges of hooks are equally and closely spaced, and that the hooks have a constant head width. The hooks are so closely spaced that two sheets of hooks cannot be pressed together without deforming the hooks as they slide past one another. This deformation of the hooks requires that the operator use force to "click" the hooks into position. Without an engaging force capable of deforming the hooks, the hooks will not interlock and the fastener does not hold in place. Once interlocked, the hooks are pinned on either side by hooks from the opposing surface. Again, when two sheets of hooks are pressed together, they cannot be pulled apart without deforming the hooks, requiring a disengaging force.

This approach utilizes a constant head width of the hooks at nearly constant hook separation to control the engagement and disengagement properties of the hooks (and thus the interlocking portions of the fastener). The separation of the ridges can be described using a spacing-to-width ratio. This ratio is defined as the ratio of the center-to-center spacing of a stem portion of the ridges to the hook head width. If adjacent hooks having the same head width are disposed on a single sheet of film so that the heads abut, the center-to-center spacing of the ridges is equal to one head width, and the spacing-to-width ratio is 1. In another case, if two hook heads of equal head width have center-to-center stem spacing of a distance equal to their cumulative head width, the spacing to width ratio is 2.

A ratio of 2 defines the theoretical geometrical limit at which hooks from opposing planar sheets using the representative approach illustrated by FIGS. 1 and 2 may be spaced (assuming regularly spaced intervals) to engage or disengage normally. For ratios less than about 2, the hooks must deform as they engage or disengage.

In the representative approach indicated in FIGS. 1 and 2, the hooks deform during engagement and disengagement because the spacing to head width ratio is less than 2. As an example, one typical hook configuration has hooks spaced 50 mils apart with head widths 30 mils wide. The hook spacing to width ratio is 50 over 30, or 1.7. A large range in hook head width would be an increase or decrease of 3 mils. For the resulting 27 and 33 mil hook head widths, the spacing to width ratios are 1.9 and 1.5, respectively. Thus, for a large range of hook widths, the ratio varies by about 12% while still remaining less than 2.

BRIEF SUMMARY OF INVENTION

The invention is a mating film. The mating film comprises a base sheet having a first major surface. A plurality of generally parallel ridges project from the first major surface. The ridges comprise a stem portion attached to the base sheet and generally upright from the base sheet. A head portion of each ridge is spaced from the first major surface and extends generally laterally from the stem portion so as to define a lateral distance. The center of each stem portion of each ridge is spaced from the center of each adjacent ridge stem portion by a distance greater than about 2 times lateral distance defined by the head portion.

BRIEF DESCRIPTION OF THE DRAWINGS

In this disclosure, several devices are illustrated. Throughout the drawings, like reference numerals are used to indicate common features or components of those devices.

While the above-identified drawing figures set forth several preferred embodiments of the invention, other embodiment are also contemplated, as noted in the discussion. In all cases, this disclosure presents the invention by way of representation and not limitation. It should be understood that numerous other modifications and embodiments can be devised by those skilled in the art which fall within the scope and spirit of the principle of the invention. It should also be noted that in the following description, elements referred to generally will be indicated using a reference number (e.g. "ridges 38" or "hooks 40"), when specific elements or series of elements are referred to, they are indicated using a reference number with a letter appended, (e.g. "ridge 38A" or "hook 40A").

DESCRIPTION OF THE PREFERRED EMBODIMENT(S)

Figure 3:
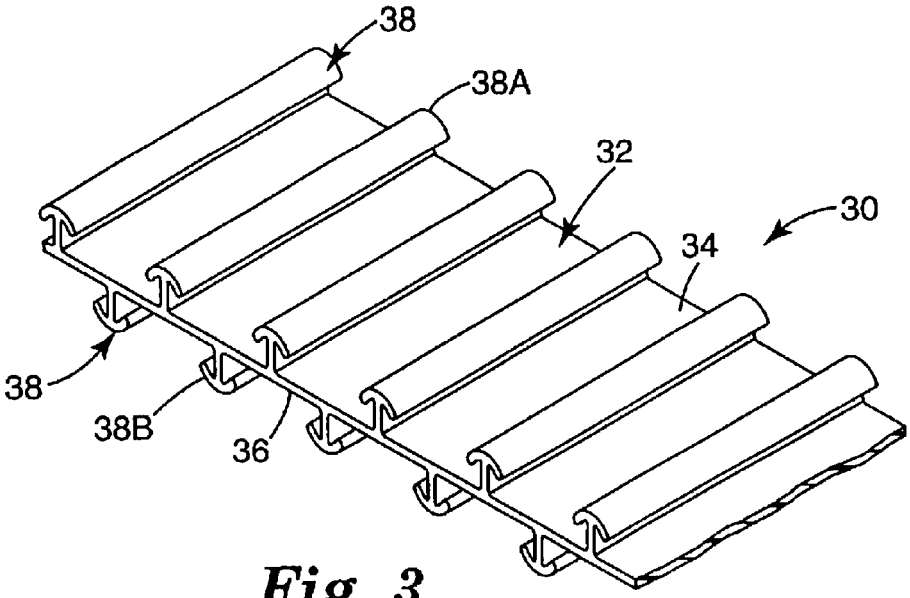
FIG. 3 is a partial isometric view of one embodiment of the inventive mating film.

The invention is a self-mating film as indicated generally in FIG. 3 at 30. The configuration of inventive mating film 30 (or "mating film fastener") allows for very low engagement forces, low peel forces (while still preventing flagging), and very high resistance to a shear load when mating film is mated to another portion of itself. Mating film 30 includes base sheet 32 having first major surface 34 and second major surface 36. In particular, a first plurality of ridges 38A extends from first major surface 34 and a second plurality of ridges 38B extends from second major surface 36.

Preferably base sheet 32 is flexible. A plurality of ridges 38 (or ribs) extends vertically (i.e., generally perpendicularly) from first and second major surfaces 34 and 36. Ridges 38 are preferably generally parallel to each other. Preferably ridges 38 are between 45 mils to 70 mils high, and base sheet 32 is about 10 mils thick. In one embodiment, base sheet 32 is formed into a tape-like shape (i.e., having a longer longitudinal dimension, a shorter lateral dimension, and a thickness). Preferably, when base sheet 32 is formed into a tape-like fashion, ridges 38 extend across base sheet 32, along the lateral direction. It should be noted that while the embodiment illustrated in FIG. 3 includes ridges 38 on both first and second major surfaces 34 and 36, other embodiments are contemplated with ridges 38 extending vertically from only one major surface (e.g. first major surface 34 only). Additionally, while ridges 38 may be disposed from each other at constant spacing intervals, irregular spacing intervals are also contemplated.

Figure 7:
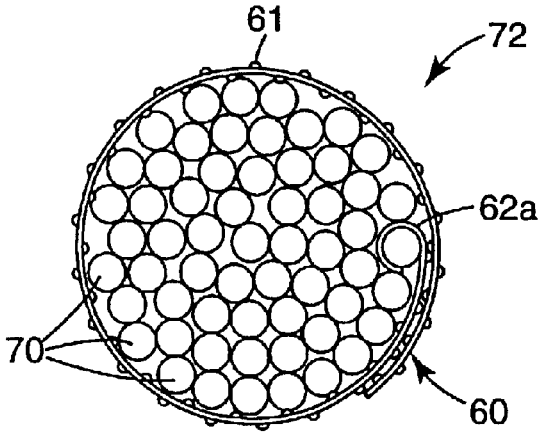
FIG. 7 is a side view of the mating film of FIG. 6*a* wrapped around a bundle of wires.

One way the inventive mating film 30 is used is by stretching the mating film 30 while wrapping it around an object, then overlapping the film on itself (discussed further with respect to FIG. 7). The mating film 30 can be used as strips, sheets, or any other shape that can be fabricated from a continuous web. In its simplest form, a strip of the mating film 30 is wrapped around an object or objects (e.g. a plurality of wires). More complex closures, pouches for example, can be made to completely enclose objects (e.g. for protection). Other fasteners can be made to secure parallel flat surfaces, like hanging items from a wall.

Figure 4:
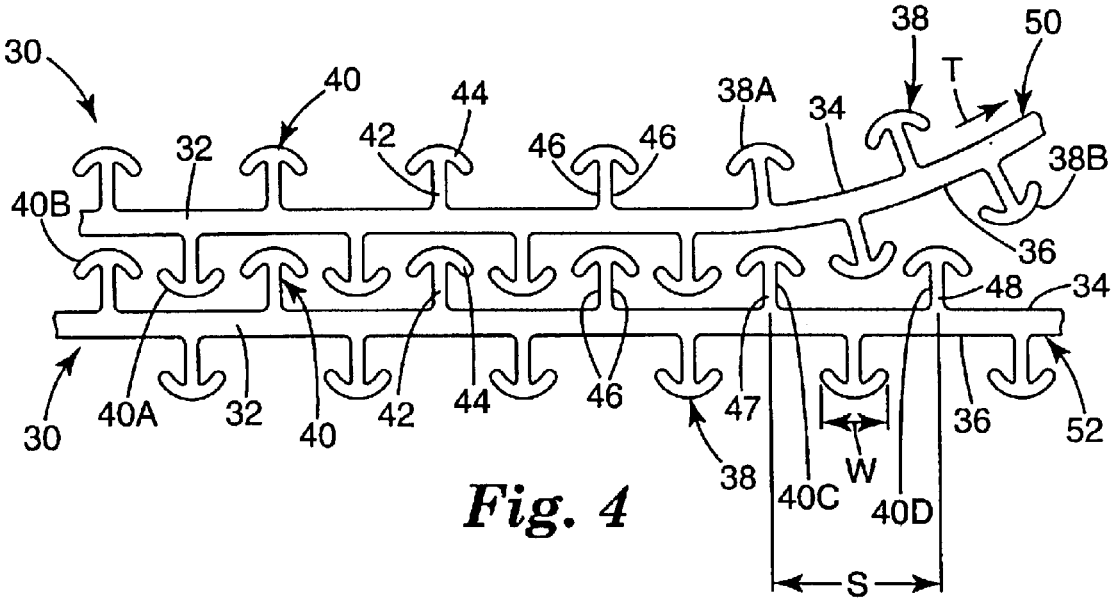
FIG. 4 is a partial magnified side view of one embodiment of the inventive mating film.

Ridges 38 in cross-section (or viewed from the side) are preferably shaped to form substantially identically shaped hooks 40, as illustrated in FIG. 4. Each hook 40 includes stem portion 42 and head portion 44. Stem portion 42 extends vertically upward from base sheet 32, or in other words generally perpendicular with respect to base sheet. Head portion 44 extends generally laterally from stem portion 42, or in other words, in a direction generally parallel to base sheet 32 and towards the most proximate adjacent hooks 40. While an "umbrella" shape hook 40 is illustrated by FIG. 4, it should be understood that other hook configurations are contemplated, such as described in the previously cited patents and publication. For example, head portion 44 could extend from only one vertical side 46 of each hook 40. Additionally, head portion 44 could extend from a variety of points along vertical side 46 of hook 40.

Hooks 40 on mating film 30 are widely spaced (indicated by "S") relative to the width (indicated by "W") of their head portions 44. The wide spacing allows hooks from adjacent layers of the mating film to easily mesh, as illustrated in FIG. 4 and wherein a first plurality of meshed hooks from first portion 50 is exemplified by hook 40A and a second plurality of meshed hooks from second portion 52 is exemplified by hook 40B. In other words, no deformation of hooks 40 is required for them to mesh, and thus very little engaging force is necessary. The meshed hooks 40 can then be locked together by shear force to provide a secure closure. This shear force can be provided by applying tension, indicated by arrow "T". Tension can be provided by stretching, or simply wrapping mating film 30 around a curve. This tension creates the resulting shear which is created by the tension itself, or elastic recovery of base sheet 32 (elastic recovery is further illustrated with respect to FIG. 5, below). This acts to securely lock first portion 50 of mating film 30 to second portion 52 of mating film 30. First and second portions 50 and 52 can be part of one continuous segment of mating film 30 (such as when mating film 30 is wrapped) or be separate non-connected portions of mating film 30, depending upon the end use fastening device application.

Figure 1:
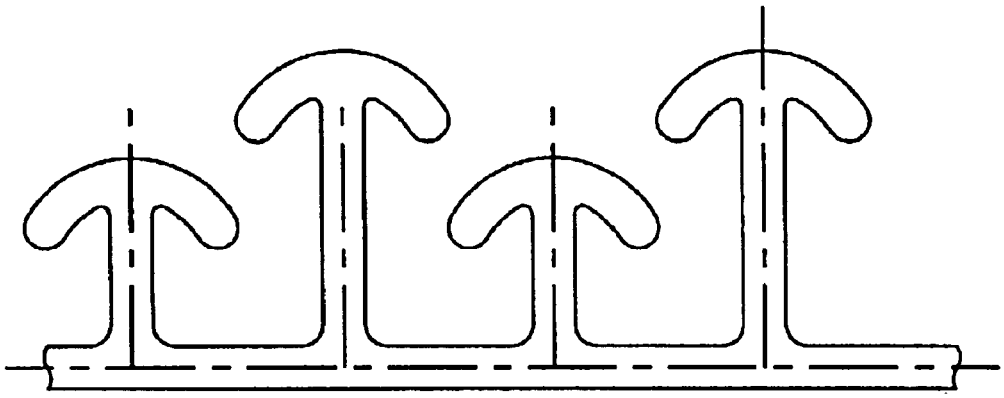
Fig. 1 PRIOR ART
FIG. 1 is a close up partial side view of a prior art self mating mechanical fastener.
Figure 2:
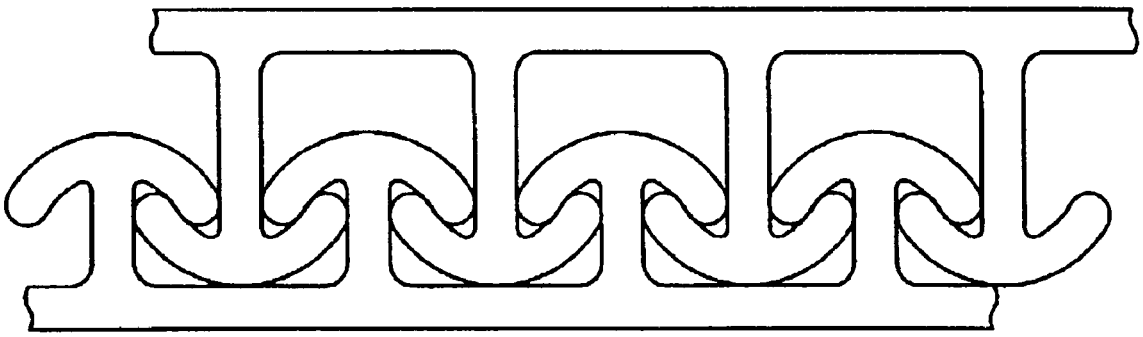
Fig. 2 PRIOR ART
FIG. 2 is a close up partial side view of a prior art self-mating mechanical fastener.
Figure 4A:
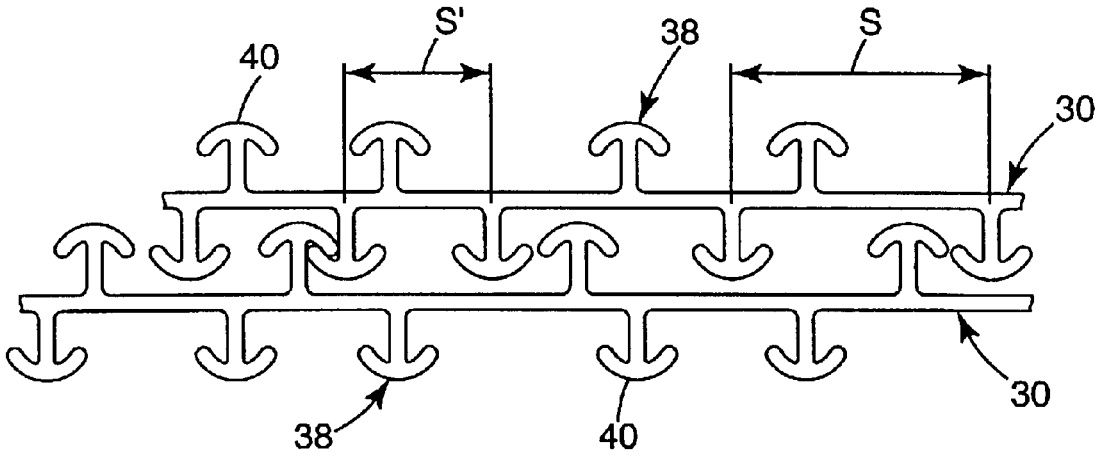
FIG. 4*a* is a partial side view of one embodiment of the inventive mating film.

It should be particularly noted that the center-to-center spacing of hooks 40 on each major surface relative to their individual head portion 44 widths is greater than that for the fastening film shown in FIGS. 1 and 2. For example as illustrated in FIG. 4, center 47 of stem portion 42 of hook 40C to center 48 of stem portion 42 of hook 40D defines the spacing distance indicated by letter "S". Preferably, hooks 40 of the inventive mating film 30 are widely spaced. Preferably, the spacing to width ratio (i.e., S/W) is higher than about 2 more preferably is higher than about 2.5 and most preferably greater than about 3. It is possible for first and second portions 50 and 52 to be brought together without any hooks 40 touching, much less deforming (as illustrated) greatly minimizing any engagement forces from that necessary in the type of devices operating as described with respect to FIGS. 1 and 2. Likewise, the two portions 50 and 52 can be lifted apart without any (or minimal) disengagement forces. Additionally, as mentioned previously, spacing "S" between ridges 38 (of hooks 40) can be about the same between adjacent hooks 40, or may be irregular in spacing varying between each pair of adjacent hooks as illustrated in FIG. 4*a* by S and S'.

It is possible that opposing hooks 40 might overlap as the first portion 50 and the second portion 52 of mating film 30 are pressed together. The opposing hooks 40 would then deform and then engage. Similarly, these hooks must deform to disengage normally. In one embodiment of the invention, ridges 38 formed on mating film 30 are spaced at irregular intervals (but at least with as much distance "S" to exceed a S/W ratio of about 2, more preferably exceeding a ratio of about 2.5 and most preferably exceeding a S/W ratio of about 3). By disposing ridges 38 at an irregular interval, the probability is increased that a few hooks 40 will align when first and second portions 50 and 52 are mated so as to deform, while most hooks 40 will not align and will not deform. Thus, while some engagement force will be required, the amount will be minimized, and much less than that required by previous methods.

The inventive mating film 30 preferably has hooks at least about 44 mils apart with head portions 44 that are 15 mils wide, for a ratio of about 3. This ratio can be increased by stretching the film along its longitudal direction (i.e., in direction "T"), particularly if film is made with an elastomeric polymer. Inventive mating films 30 with hook 40 spacing-to-width ratios (S/W) below 2 when the mating film 30 is at rest (i.e., not stretched) can be utilized as well, if the mating film 30 is stretched during wrapping to increase the (S/W) ratio to above 2 during engagement of first portion 50 with second portion 52.

Mating film 30 can be stretched well beyond the yield of base sheet 32. The spacing between ridges 38 is then greatly increased. One embodiment of inventive mating film 30 utilizes spacing to width ratios of over 20. In spite of the large relative spacing between hooks 40, the mating film 30 still wraps securely because there only needs to be a small number of hooks engaged to securely fasten. As long as there is a recoverable force (such as due to elasticity), the strip will engage. Therefore, the inventive mating film 30 may utilize a large range in the spacing-to-width ratio.

It is desirable for mating film 30 to have a low engagement force, high but appropriate disengagement forces, and good shear performance. There needs to be enough resistance to shear for hook 40 to stay engaged under a load without deformation or failure. More preferably, mating film 30 has no engagement forces, a low disengagement force which is sufficient to prevent flagging (i.e., unfurling or unrolling), and good shear performance, for the desired end use application.

Inventive mating film 30 engages by shear movement (i.e., longitudinal translation of base sheet 32) in addition to normal movement (i.e., movement perpendicular to base sheet 32 which causes the "meshing" of hooks 40). For example, if first and second portions 50 and 52 of inventive mating film 30 are moved normally such that they are close enough for hooks 40 on first and second portions 50 and 52 to overlap, as illustrated in particular by hooks 40A and 40B in FIG. 4, and there is longitudinal motion of the layers, such as in the direction indicated by "F" of FIG. 5, hooks 40 translate longitudinally towards one another until they engage (as exemplified by hooks 40A and 40B). This is analogous to a boat anchor dragging across a seabed until it snags on an object. As discussed previously, one way to provide shear force to cause this longitudinal translation of first and second portions 50 and 52 with respect to each other is to stretch mating film 30 just before bringing first and second portions 50 and 52 into contact. Then the elastic recovery of mating film 30 provides the shear force (i.e., force in the longitudinal direction indicated by "F") to engage the mating surfaces. Thus, the inventive mating films 30 are preferably made from elastomers. Specifically, there needs to be enough elastic recovery to provide shear to engage. While elastic recovery is one method of providing shear force, any method of providing shear force can be used to cause the engagement (or "fastening") of the inventive mating film 30. One way of providing shear forces between layers of a fastener formed from mating film 30 includes gravity, such as is caused by mounting an object to a wall. Another way is by wrapping the mating film 30 around itself, relying on the tendency of mating film 30 to unwrap. Another way is by wrapping a compressible elastic object, such as a belt or shoe, which urges mating film 30 to unwrap due to the objects tendency to expand. These methods of providing shear force should be interpreted as exemplary only, and not limiting in the number of ways shear force can be provided.

Figure 5:
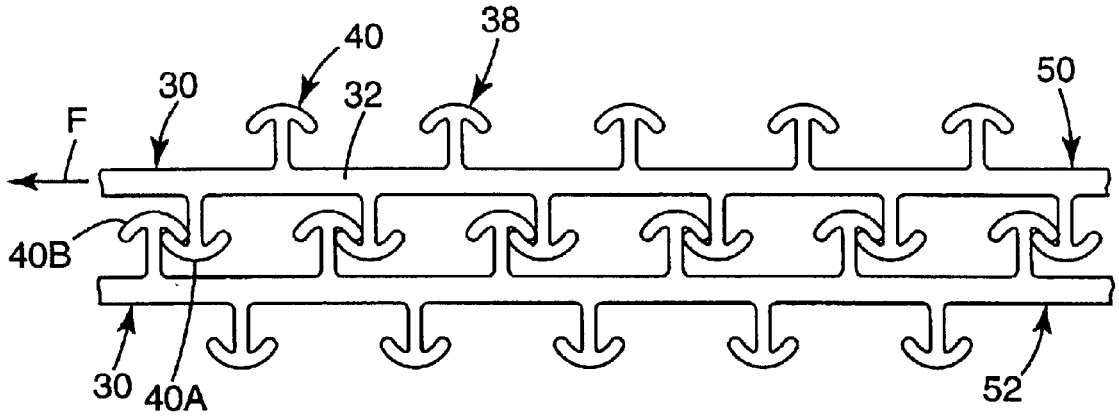
FIG. 5 is a partial magnified side view of one embodiment of the inventive mating film.
Figure 6A:
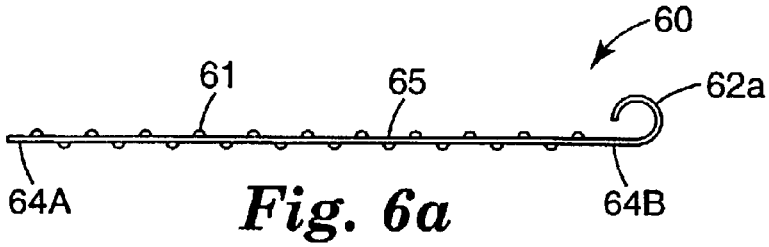
FIG. 6*a* is a side view of one embodiment of a mating film with a clip.
Figure 6B:
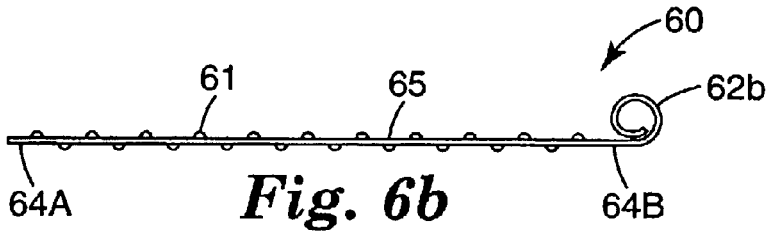
FIG. 6*b* is a side view of a second embodiment of a mating film with a clip.
Figure 6C:
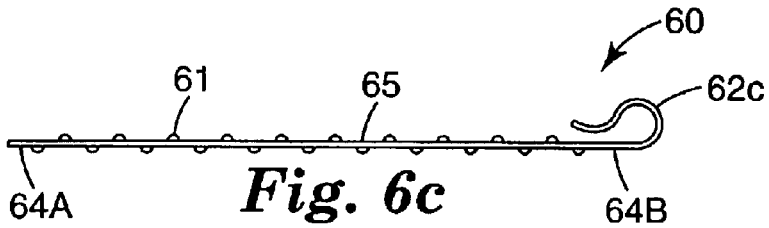
FIG. 6*c* is a side view of a third embodiment of a mating film with a clip.
Figure 6D:
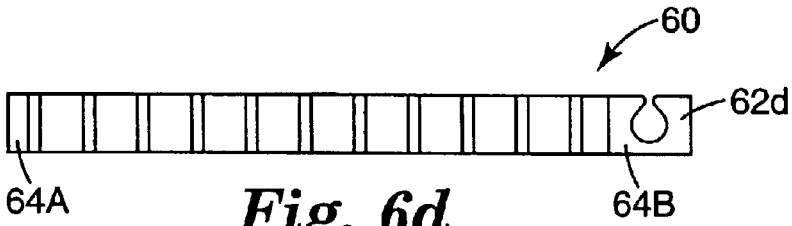
FIG. 6*d* is a top view of a fourth embodiment of a mating film with a clip.

Once first and second portions 50 and 52 are engaged, at least some hooks 40 from first and second portions 50 and 52 are in contact. As illustrated in FIG. 5, only two hook engagement (specifically exemplified by hooks 40A and 40B) is used, as opposed to the three-hook engagement previously described and illustrated by FIG. 2. In other words, as illustrated by FIG. 2, each hook is engaged by the two opposing adjacent hooks. In the current invention illustrated in FIG. 5, each hook 40 is engaged by a single opposing adjacent hook 40. Although some distortion of hooks occurs as first and second portion 50 and 52 are separated, the total distortion and disengagement force is reduced compared to that of the exemplary fasteners described with respect to FIGS. 1 and 2.

Previous mating films utilizing closely spaced hooks required the hooks to index correctly (i.e., align perfectly one to one) between layers of the film. When previous mating films were wrapped around an object, the difference in the radius of curvature between the layers of the film caused mis-indexing of the ridges. The outward pointing ridges were spread apart and the inward pointing ridges were compressed. This mis-indexing could increase the force required to force the hooks past one another during engagement and resulted in mismatched ridges that could not be engaged at all. The inventive mating film 30 does not need hooks 40 to index match between layers. The geometric changes in the spacing of ridges 38 caused by curvature have little influence on engagement, since the longitudinal translation of first and second portions 50 and 52, with respect to each other, cause hooks 40 to engage each other. Every hook 40 on mating film 30 does not need to engage in order for the invention to function. Spacing of the hooks 40 and hook head 44 width can be varied according to the desired end use application.

An additional advantage of the present inventive mating film 30 is that the inventive mating film 30 can vary greatly in the stiffness of the material used for hooks 40. This is due to the fact that hooks 40 are not required to deform in order to engage each other. Because mating film 30 is engaged by shear, the mechanical rigidity of hooks 40 is not a large design issue. The hooks 40 only need enough stiffness to function well in shear (so as to resist the applied shear load and required end use application shear loads) as well as preventing flagging). Additionally the inventive mating film may separate by peeling, have peel type of separation, but may also disengage by reverse shear unhooking of ridges 38 so that high rigidity hooks 40 may be used.

Inventive mating film 30 may be made from a variety of materials but most commonly are made from polymeric materials, using generally any polymer that can be melt processed. Thermoset materials, thermoplastic polymers such as homopolymers, copolymers and blends of polymers are useful, and may contain a variety of additives. Inorganic materials such as metals may also be used. Generally a flexural modulus of from 50 MPa to 1500 MPa for the composition of the mating film 30 including any additives is satisfactory but this may change depending on the application.

Suitable thermoplastic polymers include, for example, polyolefins such as polypropylene or polyethylene, polystyrene, polycarbonate, polymethyl methacrylate, polyesters preferably polyetheresters, ethylene vinyl acetate copolymers, acrylate-modified ethylene vinyl acetate polymers, ethylene acrylic acid copolymers, nylon, polyvinylchloride, and engineering polymers such as polyketones or polymethylpentanes. Elastomers include, for example, natural or synthetic rubber, styrene block copolymers containing isoprene, butadiene, or ethylene (butylene) blocks, metallocene-catalyzed polyolefins, polyurethanes, and polydiorganosiloxanes. Mixtures of the polymers and/or elastomers may also be used.

Suitable additives include, for example, plasticizers, tackifiers, fillers, colorants, ultraviolet light stabilizers, antioxidants, processing aids (urethanes, silicones, fluoropolymers, etc.), low-coefficient-of-friction materials (silicones), conductive fillers to give the fastener a level of conductivity, pigments, and combinations thereof. Generally, additives can be present in amounts up to 50 percent by weight of the composition depending on the application.

Mating films 30 of the invention can be formed in a manner known in the art, such as by extruding a polymeric web through a die (not shown) having an opening cut, for example, by electrical discharge machining. The shape of the die is designed to generate a web (not shown) with a desired cross-sectional shape or profile. The web is generally quenched after leaving the die by pulling it through a quenching material such as water. A wetting agent may be required in the quenching medium to assure good wetting of the whole surface of the extruded web, including spaces between ridges.

Extrusion is strongly preferred, but instead of extruding, fasteners of the invention can be prepared in other ways, for example, by injection molding or casting. Also, ridged fastener structure of the invention can be incorporated into a larger article having other functions besides fastening. For example, a frame could be mounted on a wall to support a picture or other display using the inventive mating film 30. The fastener structure can be incorporated into the larger article in various ways, e.g., by inserting an already prepared fastener into a mold and molding the rest of the article around the fastener; or by configuring a mold surface with mold structure shaped to form a fastener structure of the invention. When ridged fastener structure of the invention is incorporated into a larger article such that ridges extend directly from the article, the term "base sheet" herein includes the structure of the article into which the fastener structure is incorporated.

As previously stated, mating film 30 may include multiple layers, generally of different composition. Such multiple layers can be provided by coextrusion techniques (as described, for example, in U.S. Pat. No. 6,106,922, published Apr. 15, 1999), which may involve passing different melt streams from different extruders into a multiple-manifold die or a multiple-layer feed block and a film die (not shown). The individual streams merge in the feed block and enter the die as a layered stack that flows out into layered sheets as the material leaves the die. The die is patterned to form the ridged configuration of the mating film 30. Mating film 30 of the invention thus may have base sheet 32 of one composition and ridges 38 of a different composition. Alternatively, one portion of ridges 38 may have a different composition from other portions of the same ridge 38. For example, the portion of the ridge 38 furthest from base sheet 32 may include a composition that forms a lower-friction surface than the rest of ridge 38.

Mating film fasteners 30 embodied in the present invention have a number of important advantages, which adapt the mating film fasteners 30 to a number of important uses. For example, because the mating film 30 is self-mating, inventory requirements and related costs are reduced. This is due to the fact that the manufacturing process is simplified (i.e., only one web is used, and no lamination is required). In addition, one longitudinal piece of a single mating film 30 can be used as a complete closure device, as when the mating film fastener takes the form of a tape or strap wrapped around a bundle of items (discussed further with respect to FIG. 7).

Base sheet 32 of mating film 30 should have adequate tensile strength to resist tensions during use. This tensile strength may be provided by choice of composition of base sheet 32, manufacture of mating film 30 as a coextruded product with a material for base sheet 32 specially adapted for use as a tensile strap, or addition of a sheet or layer to base sheet 32. Mating film 30 may be twisted and wrapped to allow the ridges 38 surfaces from one surface (e.g. first major surface 34) at the respective ends of the strap to interengage. Or ridges 38 may be provided on both sides of the base sheet 32 (i.e., both first major surface 34 and second major surface 36). Opposite longitudinal ends of mating film 30 may have ridges 38 on opposite surfaces of mating film 30 strap, with the result that ridges 38 may be inter-engaged without twisting the strap.

In an alternate preferred embodiment of the invention, mating film 60 having base film 65 and ridges 61 can be combined with integrated clips 62*a*–62*d*, as shown in FIGS. 6*a*–6*d*. Mating films 60 can be used to bundle to all sorts of items, including electrical wires, tubes, hoses or any other item that may require binding or girding. It should be noted that mating film 60 illustrated in FIGS. 6*a*–7 includes ridges as described previously with respect to FIGS. 3–5. The scale of FIGS. 6*a*–7, however, is such that hooks 40 formed ridges 38 are not illustrated.

As illustrated, each integrated clip 62*a*–62*d* (referred to generally as "integrated clips 62") can be a variety of configurations depending upon the end use fastening application. For example, integrated clip 62*a* is a simple "C" shaped curved configuration. Integrated clip 62*b* is formed in the shape of a coil. The particular advantage of a coil configuration is the expandability of the coil to fit various object diameters. Integrated clip 62*c* is formed in a "bobby pin" shaped configuration, while integrated clip 62*d* is disposed in the longitudinal and lateral plane forming base sheet 32. It should be noted that while integrated clip 62 configurations shown by FIGS. 6*a*–6*d* are illustrative of different configurations which may be used as part of mating film 60, other clip configurations may be used without departing from the spirit and scope of the invention.

Integrated clips 62 can be formed on one or both longitudinal ends 64*a* and 64*b* of mating film 60 in several ways, depending on the rigidity and formability of the polymer from which the mating film 60 was made. For example, integrated clip 62 can be fashioned by thermoforming a sheet of polyester into integrated clip 62 and attaching integrated clip 62 to one longitudal end 64*b* of base sheet 65 of mating film 60. The connection of integrated clip 62 is preferably permanent, but could be made removable. Alternatively, clip can be formed from the profile-extruded web itself, or can be glued or welded to the web.

Integrated clip 62*a* can be used to secure mating film 60 to one strand 70 in bundle 72 as illustrated in FIG. 7. Such a configuration holds mating film 60 in place when mating film 60 is wrapped around the bundle. Using integrated clip 62 to attach mating film 60 (also known as a "bundling strap") to a wire or a strand is easier than threading and cinching a strap to a wire. Integrated clip 62 is simply pulled over one or more strand(s) in bundle 72 and the mating film 30 is wrapped and then secured in place. Use of mating film 30 allows tight bundling of strands 70, which allows for ease in providing shear forces. This occurs because mating film 30 can be wrapped directly around bundle 72 without requiring the operator to place his fingers on mating film 30 to hold it in place as mating film 30 is wrapped. While integrated clips are illustrated for use with inventive mating film as described in FIGS. 1–5, other types of film and mating devices such as those described in the background (e.g. hook and loop) may also utilize a clip attached to a longitudinal end in order to secure the fastener in place as it is being wrapped or otherwise secured.

EXAMPLES

The stretch locking mating films described in the following examples were profile extruded on a pilot line. Many samples of stretch locking mating film were made from thermoplastic elastomers such as Engage®, Dupont Dow Elastomers L.L.C., Wilmington, Del., Hytrel®, DuPont Engineering Polymers, Wilmington, Del., and Santoprene®, Advanced Elastomer Systems, L.P., Akron, Ohio. However, other samples were made from polyethylene and polyethylene/polypropylene copolymers.

The main components of the pilot line are a single screw extruder, a die, a die lip, a quench tank, and a take-up winder all of which are common components known to one skilled in the art. An 8-inch wide flexible lip film die was a modified to accept a dual-sided profile die lip. Film was extruded through the die lip in the direction that is perpendicular to the plane of the picture shown in FIGS. 8 and 9.

The modifications to the die included an insert to allow for the tall features of the dual-sided die lip and holes tapped into the flexible lip to secure the upper part of the die lip. The die lip was bolted onto both the base of the die (the lower half) and lip of the die (the upper half).

Example 1

Figure 8:
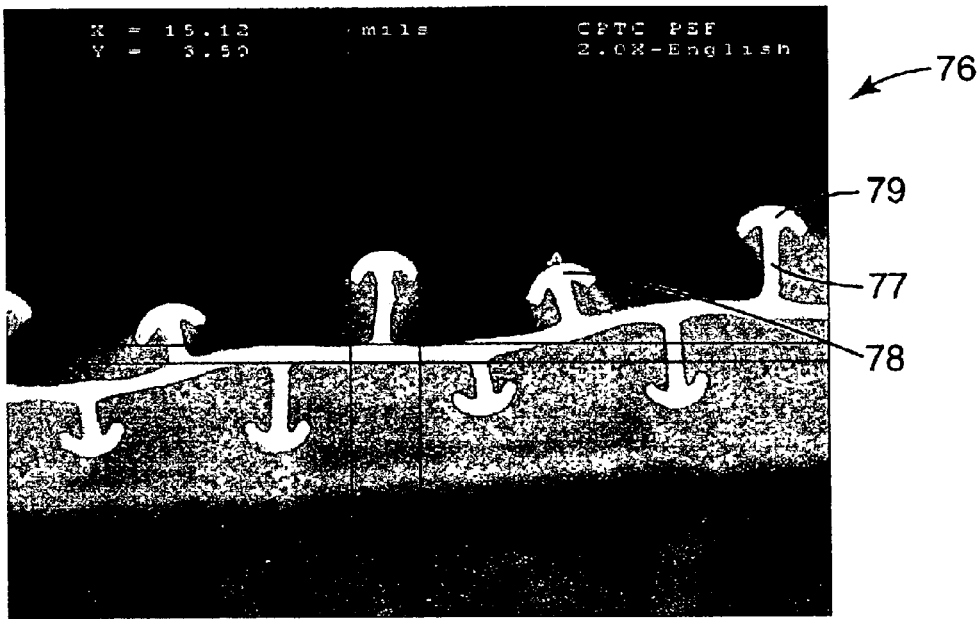
FIG. 8 is a close up cross sectional photograph of the inventive mating film according to the present invention.
Figure 9:
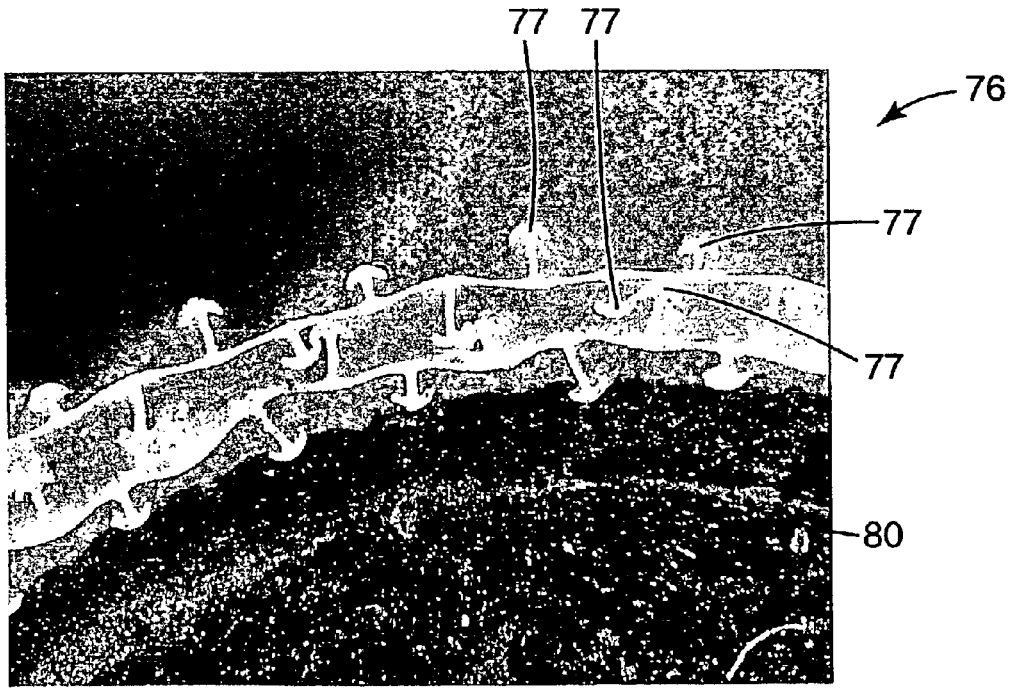
FIG. 9. is a close up cross sectional photograph of the inventive mating film shown interlocked.

Mating film 76 is shown in FIGS. 8 and 9. This mating film 76 was made of Hytrel® 4056, DuPont Engineering Polymers, Wilmington, Del., a thermoplastic polyester elastomer. FIG. 8 shows a cross-sectional profile of mating film 76. FIG. 9 shows film 76 wrapped around screw head 80 with interlocked hooks 77.

Mating film 76 has approximately a 44 mil hook 77 spacing and approximately a 16-mil hook head portion 78 width, for a ratio of about 2.8. Preferably mating film 76 is constructed so that the applied load during use of mating film 76 is perpendicular to ridge 79 orientation. Ridges 79 are oriented normal to the plane of FIG. 8.

Example 2

Figure 10:
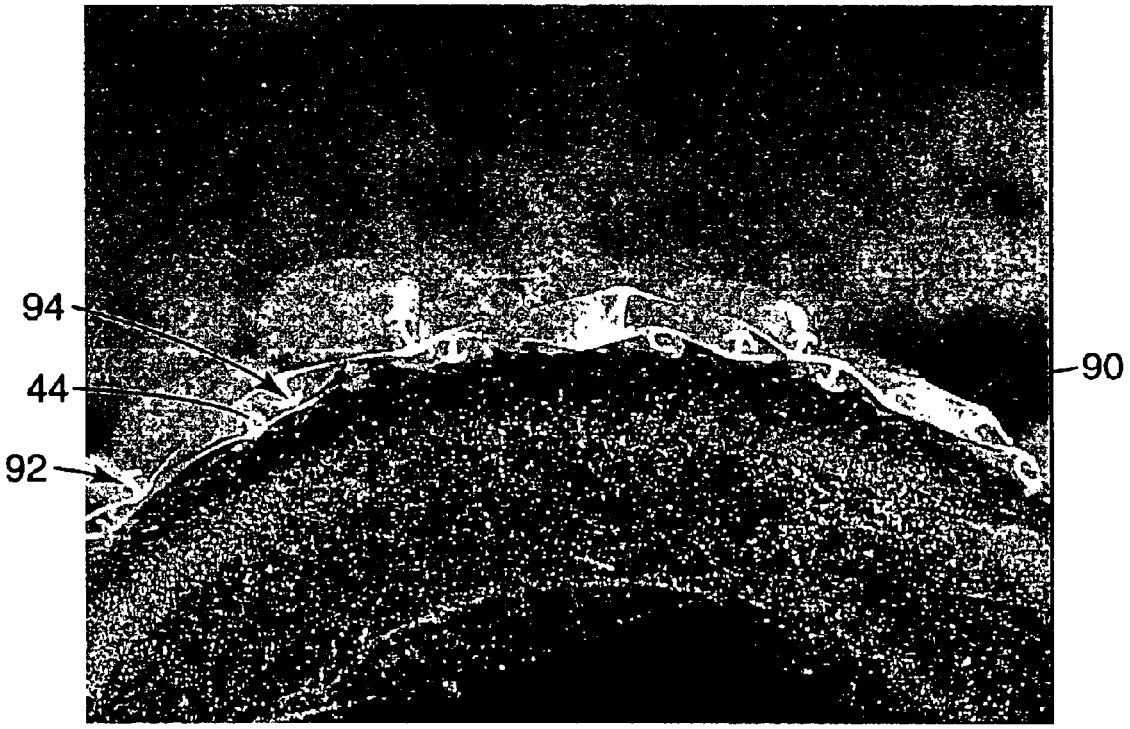
FIG. 10 is a close up cross sectional photograph of the inventive mating film shown interlocked.

Mating film 90, as illustrated in FIG. 10, made according to the present invention was stretched well beyond its yield strain and then tightly wrapped around the head of a screw. When mating film 90 yielded, ridges 92 of hooks 94 were distorted and became curved and wavy. However, the waviness did not prevent mating film 90 from interlocking.

The strip of mating film 90 used in Example 2 was cut from the same web as the strip shown in FIG. 8 and in FIG. 9. However, after being stretched, hooks 94 were about 200 mils apart. The width of each head portion 44 was 16 mils, resulting in a spacing-to-width ratio of 13.

Thus, objects can be securely wrapped with mating films that have high hook spacing to width ratios and some deformation of the hook ridges.

Various modifications and alterations of this invention will become apparent to those skilled in the art without departing from the scope and principles of this invention, and it should be understood that this invention is not to be unduly limited to the illustrative embodiments set forth hereinabove. All publications and patents are incorporated herein by reference to the same extent as if each individual publication or patent was specifically and individually indicated to be incorporated by reference.

What is claimed:

1. A re-fastenable mating film comprising:

a base sheet having a first major surface;

a plurality of generally parallel ridges projecting from the first major surface each of the plurality of ridges comprising a stem portion attached to and generally upright from the base sheet and a head portion spaced from the first major surface extending generally laterally from the stem portion 30 as to define a lateral distance, and wherein the center of each ridge stem portion is spaced from the center of each adjacent ridge stem portion by a distance greater than about 2 times the lateral distance defined by the head portion;

a second major surface on the base sheet; and a plurality of generally parallel ridges projecting from the second major surface.

2. The mating film according to claim 1 in which the ridges extend transversely across the base sheet.

3. The mating film according to claim 1 wherein at least one of the base sheet and the ridges is at least in part made from an elastomeric polymer.

4. The mating film according to claim 1 wherein the base sheet and the ridges are co-extruded from different polymers.

5. The mating film of claim 1 wherein spacing varies between each adjacent ridge stem portion.

6. The mating film of claim 1 wherein spacing is substantially constant between each adjacent ridge stem portion.

7. The mating film of claim 1 wherein each adjacent ridge stem portion is substantially identically shaped.

8. The mating film of claim 1 and farther comprising:

a clip disposed at one longitudinal end of the base sheet.

9. The mating film according to claim 8, wherein the clip is formed of a material different than that of the base sheet.

10. The mating film of claim 8 wherein the clip is shaped to form a "C".

11. The mating film of claim 8 wherein the clip is formed integrally with the base sheet.

12. A mating film comprising:

a base sheet having a first major surface and a second major surface;

a first plurality of generally parallel ridges extending from the first major surface, the plurality of first ridges comprising a first stem portion attached to and generally upright from the base sheet and a first head portion spaced from the first major surface extending generally laterally from the first stem portion so as to define a first lateral distance;

a second plurality of generally parallel ridges extending from the second major surface, the second plurality of ridges comprising a second stem portion attached and generally upright from the base sheet and a second head portion extending generally laterally from the second stem portion so as to define a second lateral distance;

wherein the center of each first ridge is spaced from the center of each adjacent first ridge greater than about 2.5 times the first lateral distance defined by the first head portion;

wherein the center of each second ridge is spaced from the center of each adjacent second ridge greater than about 2.5 times the second lateral distance defined by the second head portion; and a clip disposed on one longitudinal end of the base sheet.

13. A re-fastenable mating film comprising:

a base sheet having a first major surface;

a plurality of generally parallel ridges projecting from the first major surface and extending transversely across the base sheet, each of the plurality of ridges comprising a stem portion attached to and generally upright from the base sheet and a head portion spaced from the first major surface extending generally laterally from the stem portion so as to define a lateral distance; and wherein the center of each ridge stem portion is spaced from the center of each adjacent ridge stem portion by a distance greater than about 2.5 times the lateral distance defined by the head portion;

a second major surface on the base sheet; and a multiplicity of generally parallel ridges projecting from the second major surface.

14. The mating film of claim 13 and further comprising:

a clip disposed at one longitudinal end of the base sheet.

15. The mating film of claim 13 wherein spacing varies between each adjacent ridge stem portion.

16. A re-fastenable mating film comprising:

a base sheet having a first major surface;

a plurality of generally parallel ridges projecting from the first major surface and extending transversely across the base sheets each of the plurality of ridges comprising a stem portion attached to and generally upright from the base sheet and a head portion spaced from the first major surface extending generally laterally from the stem portion so as to define a lateral distance; and wherein the center of each ridge stem portion is spaced from the center of each adjacent ridge stem portion by a distance greater than about 3 times the lateral distance defined by the head portion;

a second major surface on the base sheet; and a plurality of generally parallel ridges projecting from the second major surface.

17. The mating film of claim 16 and further comprising:

a clip disposed at one longitudinal end of the base sheet.

18. The mating film of claim 16 wherein spacing varies between each adjacent ridge stem portion.

19. A method for fastening comprising:

disposing a first portion of a base sheet having a first major surface and a first plurality of hook shaped ridges projecting from the first major surface proximate a second portion of the base sheet having a second plurality of ridges translating the first portion of the base sheet normally towards the second portion of the base sheet;

overlapping the hook shaped ridges of the first portion and the hook shaped ridges of the second portion;

translating the first portion longitudinally with respect to the second portion; and engaging each ridge of a portion of the plurality of the ridges of the first portion of the base sheet with only one of the plurality of ridges of the second portion.

20. The method of claim 19 and farther comprising:

using constant spacing distance between the first plurality of ridges.

21. The method of claim 19 and further comprising:

using irregular spacing distances between the first plurality of ridges.

22. The method of claim 19 and further comprising:

elastically deforming the base sheet to provide longitudinal translation between the first portion and the second portion.

* * * * *

UNITED STATES PATENT AND TRADEMARK OFFICE

CERTIFICATE OF CORRECTION

PATENT NO. : 6,763,556 B2
DATED : July 20, 2004
INVENTOR(S) : Fagan, Mark E.

It is certified that error appears in the above-identified patent and that said Letters Patent is hereby corrected as shown below:

Column 10,
Line 24, after "portion" delete "30", insert in place thereof -- so --;
Line 25, after "distance" delete ",", insert in place thereof -- ; --;
Line 47, delete "farther", insert in place thereof -- further --;

Column 11,
Line 40, delete "sheets", insert in place thereof -- sheet, --;

Column 12,
Line 31, delete "farther", insert in place thereof -- further --.

Signed and Sealed this

Third Day of May, 2005

JON W. DUDAS
*Director of the United States Patent and Trademark Office*